US008201428B2

(12) United States Patent
Wilkes et al.

(10) Patent No.: US 8,201,428 B2
(45) Date of Patent: Jun. 19, 2012

(54) MULTIPART PUNCH FOR HYDRO PIERCING

(75) Inventors: Richard J. Wilkes, Alliston (CA); Pascal P. Charest, Caledon (CA)

(73) Assignee: Magna International Inc., Aurora, Ontario (CA)

( * ) Notice: Subject to any disclaimer, the term of this patent is extended or adjusted under 35 U.S.C. 154(b) by 686 days.

(21) Appl. No.: 12/090,523

(22) PCT Filed: Oct. 20, 2006

(86) PCT No.: PCT/CA2006/001726

§ 371 (c)(1), (2), (4) Date: Apr. 17, 2008

(87) PCT Pub. No.: WO2007/045098

PCT Pub. Date: Apr. 26, 2007

(65) Prior Publication Data

US 2009/0044584 A1 Feb. 19, 2009

Related U.S. Application Data

(60) Provisional application No. 60/728,811, filed on Oct. 20, 2005.

(51) Int. Cl.

| | |
|---|---|
| ***B21D 26/00*** | (2006.01) |
| ***B21D 31/02*** | (2006.01) |
| ***B26D 3/10*** | (2006.01) |

(52) U.S. Cl. ..... 72/55; 72/58; 72/325; 83/54

(58) Field of Classification Search ..... 72/55, 58, 72/325, 327, 370.27; 83/53, 54

See application file for complete search history.

(56) References Cited

U.S. PATENT DOCUMENTS

| | | | |
|---|---|---|---|
| 6,305,201 | B1 | 10/2001 | Ghiran et al. |
| 7,127,924 | B1 | 10/2006 | Ghiran |
| 2006/0065030 | A1 | 3/2006 | Ghiran et al. |

*Primary Examiner* — Debra Sullivan

(74) *Attorney, Agent, or Firm* — Harness, Dickey & Pierce, P.L.C.

(57) ABSTRACT

A novel multipart punch and system allows apertures to be formed in hydroformed members with the slug which would otherwise result being divided into two or more smaller slugs. These smaller slugs can be folded back into the hydroformed member and held captive therein or removed if desired. The multipart punch and system provides a flush surface in the hydroforming mold when the punch is in its initial position to allow easy loading and unloading of the mold and to allow additional blank to be fed into the mold during the hydroforming operation, if desired. Also, the hydraulic ram used with the multipart punch need develop less force than an equivalent prior art stepped punch.

12 Claims, 3 Drawing Sheets

MULTIPART PUNCH FOR HYDRO PIERCING

CROSS-REFERENCE TO RELATED APPLICATIONS

This application claims the benefit of U.S. Provisional Application No. 60/728,811, filed on Oct. 20, 2005. The disclosure of the above application is incorporated herein by reference.

FIELD OF THE INVENTION

The present invention relates to a punch for forming apertures in hydroformed metal members. More specifically, the present invention relates to a multipart punch for forming such apertures having two or more slugs.

BACKGROUND OF THE INVENTION

Hydroforming is now widely employed for forming strong and light weight metal members for vehicle chassis and the like. In hydroforming, a tubular metal blank is placed into a mold and the blank is then expanded to conform to the mold by filling the blank with pressurized fluid, typically water.

As a follow on step to the hydroforming process, before depressurizing the formed member and removing it from the mold, it is known to punch any needed apertures into the member with punches. These punches are typically operated via hydraulic pistons and operate much like conventional punch and dies, except the pressure of the fluid in the hydroformed member removes the need for a die, as the pressure holds the wall of the member against the movement of the punch.

To avoid an additional manufacturing step, the slugs formed by the punching of the apertures are often held captive within the hydroformed member by a feature on one side of the punch which ensures that a portion of one side of the slug remains attached to the member. The slug is folded back about this portion, into the interior of the member, by the movement of the punch during the punch operation, and is held captive by this portion without obscuring the opening of the aperture.

However, when it is desired to punch relatively large (in comparison to the diameter of the hydroformed member) apertures, it can be difficult or impossible to form such apertures as the slug may abut a portion of the interior of the member during the punching operation.

Even in circumstances wherein the large aperture can be punched, it may be impossible to form a captive slug, as the slug may abut a portion of the interior of the member as it is folded, preventing the slug from being folded out of the way and thus at least partially obscuring a portion of the opening of the aperture.

Accordingly, to punch such relatively large apertures, it is known to use a stepped punch to form a desired aperture with two smaller slugs. If the slugs are to be captive, each slug is held captive about a different portion of the aperture and is folded back away from the other slug.

However, conventional stepped punch systems require very high punch pressures and calibration pressures (the pressure of the fluid in the hydroformed member) to operate and thus the tooling and rams for such systems are expensive and/or the cycle times for the forming and punching operation can be longer than would otherwise be the case. More significantly, stepped punches can prevent the feeding of an additional amount of blank into the mold during hydroforming, which is an often desired operation.

SUMMARY OF THE INVENTION

It is an object of the present invention to provide a novel multipart punch which obviates or mitigates at least one disadvantage of the prior art.

According to a first aspect of the present invention, there is provided a multipart punch for forming apertures in a hydroformed member, comprising: a first punch segment having a punch surface, a spaced reaction surface and a boss extending generally parallel to the reaction surface from the punch segment; a second punch segment having a punch surface, a spaced reaction surface and a groove extending along a portion of the side of the punch segment perpendicular to the reaction surface, the groove receiving the boss and limiting the movement of the second punch segment relative to the first punch segment; and a ram having a ram reaction surface to engage the reaction surface of the first punch segment and the reaction surface of the second punch segment, the ram being moveable between an initial position and an extended position, the ram reaction surface engaging the reaction surface of the first punch segment to move the first punch segment alternately between the initial position and the extended position, a clearance being provided between the second punch segment reaction surface and the ram reaction surface in the initial position such that the first punch segment can pierce the hydroformed member when the ram moves towards the extended position without movement of the second punch segment until the clearance is exhausted, after which the first punch segment and the second punch segment move with the ram to the extended position, the boss engaging an end of the groove to move the second punch segment with the first punch segment to the initial position and to reestablish the clearance.

A multipart punch for forming apertures in a hydroformed member, the punch comprising: a first punch segment to punch a first slug from the hydroformed member; a second punch segment to punch a second slug from the hydroformed member; and a ram moveable between an initial position and an extended position, the ram having a reaction surface, a clearance being provided between the second punch segment and the ram in the initial position, the ram moving the first punch segment to punch the first slug before moving the second punch segment to punch the second slug.

The present invention provides a novel multipart punch and system which allows apertures to be formed in hydroformed members with the slug which would otherwise result being divided into two or more smaller slugs. These smaller slugs can be punched and removed or, if desired, folded back into the hydroformed member and held captive therein. The multipart punch and system provides a flush surface in the hydroforming mold when the punch is in its initial position to allow easy loading and unloading of the mold and to allow additional blank to be fed into the mold during the hydroforming operation, if desired. Also, the hydraulic ram used with the multipart punch need develop less force than an equivalent prior art stepped punch.

BRIEF DESCRIPTION OF THE DRAWINGS

Preferred embodiments of the present invention will now be described, by way of example only, with reference to the attached Figures, wherein.

DETAILED DESCRIPTION OF THE PREFERRED EMBODIMENTS

Figure 1:
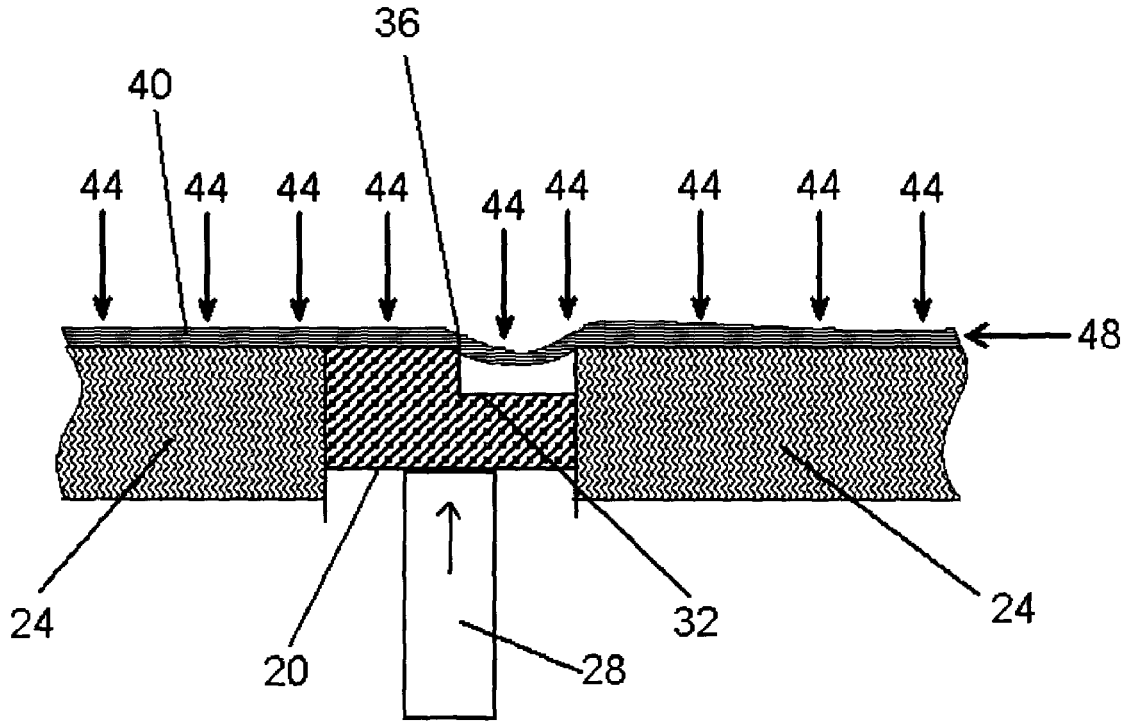
Fig. 1 (prior art)
FIG. 1 shows a prior art step punch.

Before describing the present invention, a prior art step punch system will be described, for clarity, with reference to FIG. 1 wherein a stepped punch 20 is shown installed in the wall of a hydroforming mold 24.

Punch 20 is operated by a hydraulic ram 28 and punch 20 includes a step 32 with a sharp edge 36 that is intended to shear the material of the wall of the blank 40 being formed. When punch 20 forms an aperture in the wall of blank 40, the resulting slug is sheared into two pieces by edge 36, each of which can be folded back into the interior of the resulting member formed from blank 40 and held captive without obscuring the opening of the resulting aperture.

However, such stepped punch systems suffer from disadvantages. In particular, the piercing pressure produced by ram 28, required to initiate the cut at shear edge 36, and the calibration pressure (i.e.—the maximum pressure of the fluid in the hydroformed member) must be much higher than the corresponding pressures required for use with non-stepped punches. These required higher pressures increase the cost of tooling mold 24 and for ram 28 and its associated pumps, connections and valves and also result in longer cycle times for mold 24.

More significantly, the required high calibration pressure curve 44 of the hydroforming fluid tends to distort the wall material of blank 40 over step 32 causing a material jam at edge 36, such that additional length of blank 40 cannot be fed 48 into mold 24 during the forming operation. As additional blank 40 is commonly required to be fed into molds during hydroforming, this is a significant disadvantage of stepped punch systems.

The present invention will now be described with reference to FIGS. 2 through 5. As illustrated in the Figures, a multipart punch 100 in accordance with the present invention comprises a first punch segment 104 and second punch segment 108, each of which can be driven by a ram 112.

Figure 2:
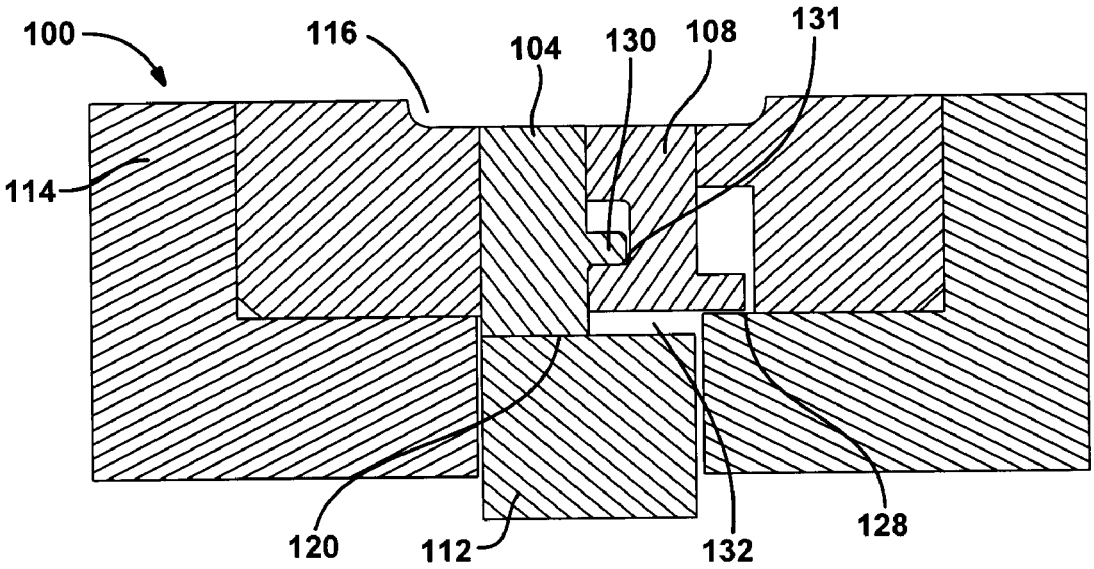
FIG. 2 shows a cross section of a multipart punch and ram in accordance with the present invention with the punch in an initial position.

In FIG. 2, multipart punch 100 is in the initial state wherein ram 112 is retracted and a blank (not shown) can be loaded into the mold 114 (only the lower half of mold 114 is shown in the illustration) or a finished part removed from mold 114. In the illustrated embodiment, multipart punch 100 is mounted in mold 114 via a piercing insert 116.

As illustrated, ram 112 has a reaction surface 120 which is mechanically mated to first punch segment 104, by a bolt or any other suitable means (not shown), such that when ram 112 is retracted, as described below, first punch segment 104 will retract with ram 112.

Second punch segment 108 abuts a stop 128, preferably formed as part of mold 114, which prevents second punch segment 108 from retracting below a flush position.

A boss 130 on first punch segment 104 is located in a groove 131 on second punch segment 108 such that, as ram 112 is retracted, boss 130 abuts one end of groove 131 to also retract second punch segment 108.

Thus, as illustrated in FIG. 2, when multipart punch 100 is in the initial state the upper surfaces of first punch segment 104 and second punch segment 108 are located substantially flush with piercing insert 116 despite the clearance 132 between second punch segment 108 and reaction surface 120 of ram 112.

Once a blank has been loaded and mold 114 has been closed, the hydroforming fluid can be injected into the blank under pressure to bring the blank into conformance with the shape of mold 114 to obtain the formed member, which process can also involve feeding an additional length of the blank into mold 114 during the hydroforming process, as is well known by those of skill in the art. In the illustrated embodiment, additional lengths of blank would be fed in a direction corresponding to a direction into or out of the page.

The flush arrangement of first punch segment 104 and second punch segment 108 in the initial state position of FIG. 2 permit the feeding of additional blank into mold 114, as needed. At the completion of the hydroforming process, when the desired formed member has been formed in mold 114, the punch process can commence.

Figure 3:
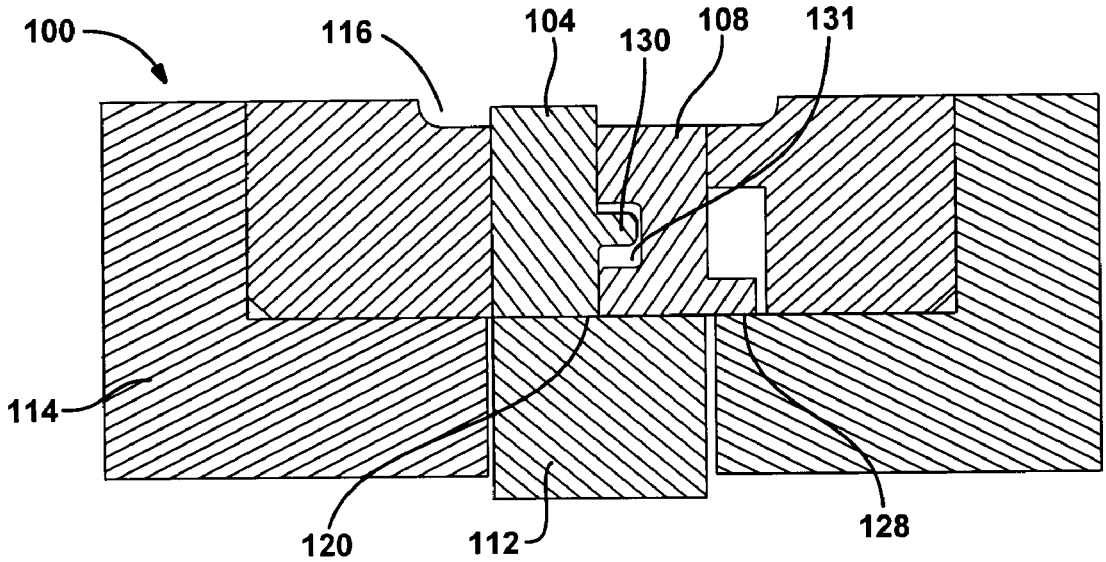
FIG. 3 shows the cross section of FIG. 2 with the ram partially extended.

In FIG. 3, the punch process has started with ram 112 having advanced and reaction surface 120 having forced first punch segment 104 up and into the formed piece. First punch segment 104 has pierced the hydroformed member while second punch segment 108 has remained motionless as clearance 132 is taken up by ram 112.

When ram 112 has advanced to the position illustrated in FIG. 3, clearance 132 has been exhausted and further advancement of ram 112 will result in reaction surface 120 engaging the bottom of second punch segment 108 to advance it. The size of clearance 132 is selected such that first punch segment 104 has completed at least its initial piercing of the hydroformed member in mold 114 before reaction surface 120 of ram 112 contacts second punch segment 108.

Figure 4:
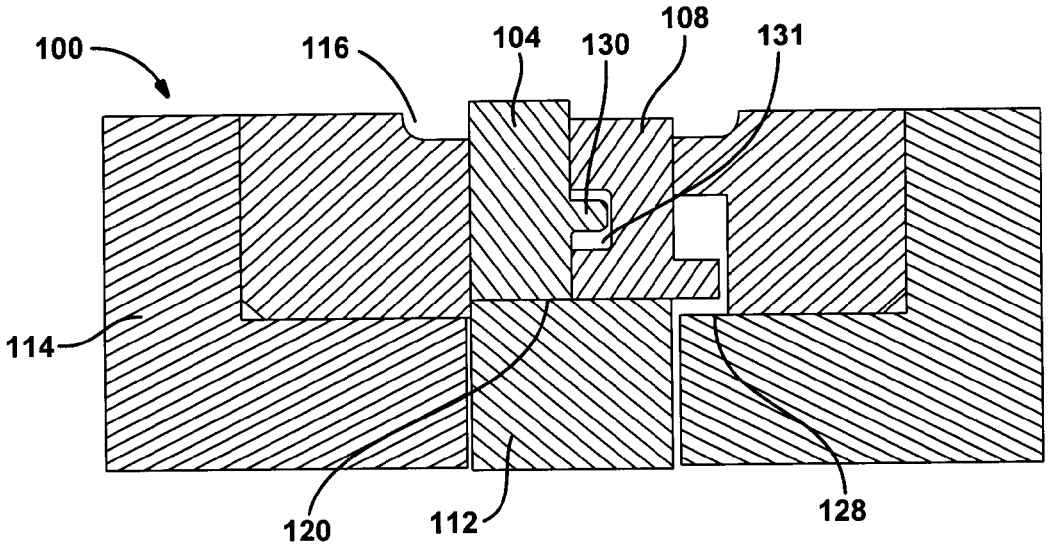
FIG. 4 shows the cross section of FIG. 2 with the ram fully extended.

FIG. 4 shows second punch segment 108 when it has been advanced by reaction surface 120 of ram 112. In this position, the punching of an aperture in the formed piece is complete with the formation of two slugs, one from first punch segment 104 and one from second punch segment 108, that can be removed or folded back and held captive within the formed piece as desired.

While in the illustrated embodiment first punch segment 104 and second punch segment 108 have substantially similar surface areas, it will be apparent that this need not be the case and, if required to form the slugs and/or to accommodate respective captive slugs within the geometry of the finished hydroformed member, the areas of first punch segment 104 and second punch segment 108 can be selected as desired.

Figure 5:
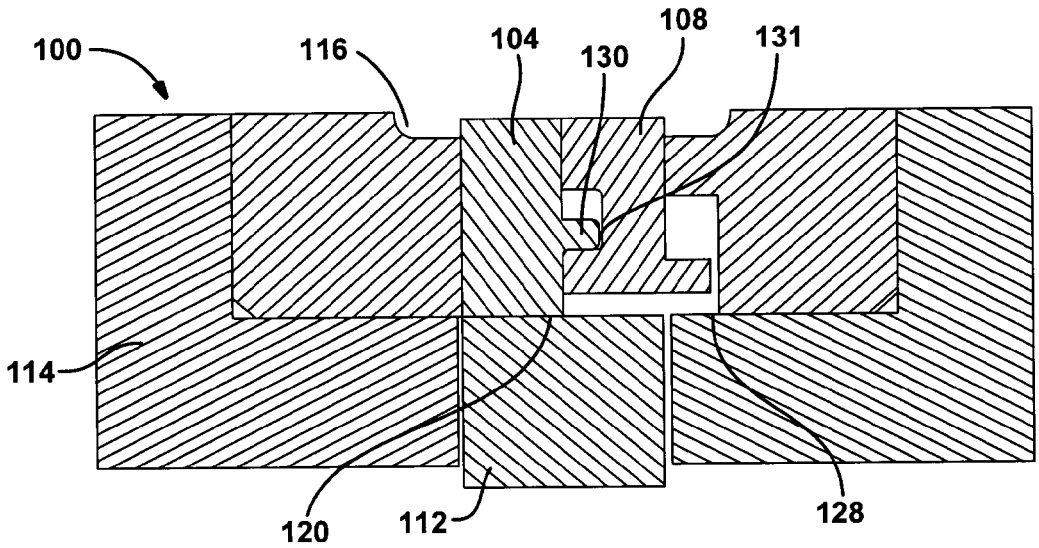
FIG. 5 shows the cross section of FIG. 2 with the ram partially retracted.

FIG. 5 shows ram 112 at a partially retracted position wherein first punch segment 104 has been retracted to the point where boss 130 abuts with an end of groove 131 of second punch segment 108. From this point, further retraction of ram 112 and first punch segment 104 will also retract second punch segment 108, via the contact between boss 130 and the end of groove 131.

The punch process completes when ram 112 is retracted to the initial position shown in FIG. 2, retracting first punch segment 104 and second punch segment 108 to the flush, initial, positions also shown in FIG. 2.

When the punching process is completed, first punch segment 104 and second punch segment 108 are withdrawn from the finished formed piece, to allow the finished formed piece to be removed from mold 114 and to start the forming and punching cycle for another blank.

As will now be apparent, multipart punch 100 offers numerous advantages over the prior art. In particular, as ram 112 moves first punch segment 104 to substantially complete its punching of a first slug from the aperture to be formed before second punch segment 108 commences its punching of the second slug, ram 112 need not develop as much hydraulic force as a stepped punch of similar size would require. Thus, ram 112 is less expensive to purchase and requires less hydraulic fluid to cycle. Further, as first punch segment 104 and second punch segment 108 assume flush initial positions, loading of additional blank into mold 114 during hydroforming is easily accomplished.

While the embodiment of the present invention illustrated in FIGS. 2 through 5 only includes two punch segments, it is contemplated that if it is desired to form an aperture with the resulting slug divided into more than two slugs, more than two punch segments can be employed. In such a case, if it is desired to capture the resulting slugs, the feature in each punch segment which results in the slugs being held captive can be arranged to ensure that the slugs do not interfere with each other during the punching operation.

The present invention provides a novel multipart punch and system which allows apertures to be formed in hydroformed members with the slug which would otherwise result being divided into two or more smaller slugs. These smaller slugs can be folded back into the hydroformed member and held captive therein, or can be removed as desired. The multipart punch and system provides a flush surface in the hydroforming mold when the punch is in its initial position to allow easy loading and unloading of the mold and to allow additional blank to be fed into the mold during the hydroforming operation, if desired. Also, the hydraulic ram used with the multipart punch need develop less force than an equivalent prior art stepped punch.

The above-described embodiments of the invention are intended to be examples of the present invention and alterations and modifications may be effected thereto, by those of skill in the art, without departing from the scope of the invention which is defined solely by the claims appended hereto.

What is claimed is:

1. A multipart punch for forming an aperture in a hydroformed member, comprising:

a first punch segment moveable between retracted and extended positions, the first punch having one of a recess and a boss;

a second punch segment having the other of the recess and the boss, wherein the boss is positioned within the recess with a clearance therebetween to allow the second punch segment to move relative to the first punch segment a predetermined amount, the first punch segment being moveable toward the extended position at least partially through the hydroformed member prior to the second punch segment moving from the retracted position;

a stop restricting the second punch segment from moving away from the hydroformed member further than the retracted position; and, a ram fixed to the first punch segment and moveable relative to the second punch segment, the ram operable to move the first punch segment at least partially through the hydroformed member prior to contacting the second punch segment, wherein the first and second punch segments each include a distal end surface adapted to contact the hydroformed member, the distal ends being substantially aligned along a common plane when the first and second punch segments are in their retracted positions, and wherein the boss is clear from sides of the recess when the ram is in contact with the second punch segment.

2. The multipart punch of claim 1, wherein the boss is operable to drive the punch segment that includes the recess from the extended position to the retracted position.

3. A multipart punch for forming an aperture in a hydroformed member, comprising:

a first punch segment moveable between retracted and extended positions, the first punch having one of a recess and a boss; and a second punch segment having the other of the recess and the boss, wherein the boss is positioned within the recess with a clearance therebetween to allow the second punch segment to move relative to the first punch segment a predetermined amount, the first punch segment being moveable toward the extended position at least partially through the hydroformed member prior to the second punch segment moving from the retracted position, wherein the punch segment that includes the recess also includes a radially outwardly extending finger captured within a pocket, the pocket limiting travel of the punch segment having the recess between the retracted position at one extreme and the extended position at the other extreme.

4. A multipart punch for forming apertures in a hydroformed member, the punch comprising:

a first punch segment to punch a first slug from the hydroformed member;

a boss extending from the first punch segment;

a second punch segment to punch a second slug from the hydroformed member, the second punch segment positioned adjacent to the first punch segment and moveable relative to the first punch segment, the second punch segment comprising a recess in receipt of the boss; and a ram moveable between an initial position and an extended position, wherein a clearance is provided between the second punch segment and the ram in the initial position, the ram moving the first punch segment to punch the first slug before moving the second punch segment to punch the second slug.

5. The multipart punch of claim 4, wherein the boss is disengaged from the second punch segment when the ram is in contact with the second punch segment.

6. The multipart punch of claim 5, wherein the boss drivingly engages the second punch segment to move the second punch segment from the extended position to the initial position when the ram moves the first punch segment from the extended position to the initial position.

7. The multipart punch of claim 4, wherein the first and second punch segments each include distal end surfaces aligned along a common plane when each punch segment is in the initial position.

8. The multipart punch of claim 7, further including a stop spaced apart from the first punch segment, the stop restricting movement of the second punch at the initial position.

9. The multipart punch of claim 4, wherein the ram is fixed to the first punch segment.

10. A multipart punch for forming apertures in a hydroformed member, comprising:

a first punch segment having a punch surface, a spaced reaction surface and a boss extending generally parallel to the reaction surface from the punch segment;

a second punch segment having a punch surface, a spaced reaction surface and a groove extending along a portion of a side of the punch segment perpendicular to the reaction surface, the groove receiving the boss and limiting the movement of the second punch segment relative to the first punch segment; and a ram having a ram reaction surface to engage the reaction surface of the first punch segment and the reaction surface of the second punch segment, the ram being moveable between an initial position and an extended position, wherein:

the ram reaction surface engages the reaction surface of the first punch segment to move the first punch segment alternately between the initial position and the extended position;

a clearance is provided between the second punch segment reaction surface and the ram reaction surface in the initial position such that the first punch segment can pierce the hydroformed member when the ram moves towards the extended position without movement of the second punch segment until the clearance is exhausted, after which the first punch segment and the second punch segment move with the ram to the extended position; and the boss engages an end of the groove to move the second punch segment with the first punch segment to the initial position and to reestablish the clearance.

11. The multipart punch of claim 10, wherein the punch surfaces of the first and second punch segments are aligned along a common plane when the punch segments are each located at the initial position.

12. The multipart punch of claim 11, wherein the second punch segment includes a finger extending generally parallel to the second punch reaction surface to limit movement of the second punch segment at the initial position.

* * * * *